US011071341B2

(12) United States Patent
Stevens

(10) Patent No.: US 11,071,341 B2
(45) Date of Patent: Jul. 27, 2021

(54) BELT LOOP WITH BELT FASTENER

(71) Applicant: Nathaniel D. Stevens, Chula Vista, CA (US)

(72) Inventor: Nathaniel D. Stevens, Chula Vista, CA (US)

( * ) Notice: Subject to any disclaimer, the term of this patent is extended or adjusted under 35 U.S.C. 154(b) by 0 days.

(21) Appl. No.: 16/867,438

(22) Filed: May 5, 2020

(65) Prior Publication Data

US 2020/0268082 A1 Aug. 27, 2020

Related U.S. Application Data

(63) Continuation of application No. 15/997,578, filed on Jun. 4, 2018, now abandoned.

(51) Int. Cl.

| | |
|---|---|
| ***A41F 9/00*** | (2006.01) |
| ***A41D 1/06*** | (2006.01) |
| ***A41D 27/00*** | (2006.01) |

(52) U.S. Cl.

CPC ..... *A41F 9/007* (2013.01); *A41D 1/06* (2013.01); *A41D 27/00* (2013.01); *A41F 9/002* (2013.01); *A41D 2200/10* (2013.01); *A41D 2300/32* (2013.01); *A41D 2400/48* (2013.01)

(58) Field of Classification Search

None

See application file for complete search history.

(56) References Cited

U.S. PATENT DOCUMENTS

| | | | | |
|---|---|---|---|---|
| 3,642,183 | A | 2/1972 | Boren | |
| 3,789,431 | A * | 2/1974 | Rand | A41F 9/007 2/236 |
| 4,063,313 | A | 12/1977 | Hagios | |
| 4,633,527 | A * | 1/1987 | Ehring | A41D 1/067 2/22 |
| 4,835,821 | A * | 6/1989 | Durante | A41D 25/003 2/144 |
| 5,060,348 | A * | 10/1991 | Moshier | A41F 15/02 24/442 |
| 5,309,575 | A * | 5/1994 | Lookhoof | A41F 9/002 2/312 |
| 5,351,340 | A * | 10/1994 | Aldridge | A41D 13/0525 2/108 |
| 5,445,566 | A * | 8/1995 | Hayes | A41D 13/088 473/62 |
| 5,584,072 | A * | 12/1996 | Kim | A63B 71/12 2/465 |
| 5,632,426 | A | 5/1997 | Beletsky | |
| 5,897,519 | A * | 4/1999 | Shesol | A61M 25/02 602/79 |
| 5,920,964 | A | 7/1999 | Malzhan | |
| 6,481,528 | B2 | 11/2002 | Antonio | |
| 6,954,946 | B2 * | 10/2005 | Goldfarb | A41F 9/002 2/338 |
| 7,921,474 | B2 | 4/2011 | Miller | |
| 8,225,976 | B2 | 7/2012 | Meunier | |

(Continued)

*Primary Examiner* — Khoa D Huynh
*Assistant Examiner* — Grace Huang
(74) *Attorney, Agent, or Firm* — GSS Law Group; Gregory S. Smith; Phillip M. Wagner

(57) ABSTRACT

A belt loop for attachment of a duty belt to a garment or other object includes a belt fastener having a piece of hook-and-loop material complementary to a piece of hook-and-loop material on the duty belt.

5 Claims, 8 Drawing Sheets

SECTION B-B

(56) References Cited

U.S. PATENT DOCUMENTS

| | | | | |
|---|---|---|---|---|
| 8,966,667 | B2 * | 3/2015 | Peck | A41D 31/185 2/227 |
| 9,339,085 | B2 * | 5/2016 | Watts | A44B 11/02 |
| 10,856,596 | B1 * | 12/2020 | Banas | A41F 9/02 |
| 2006/0151562 | A1 | 7/2006 | Moor | |
| 2007/0033698 | A1 | 2/2007 | Long | |
| 2011/0271495 | A1 | 11/2011 | Grainger | |
| 2013/0031698 | A1 * | 2/2013 | Valles | A41D 1/08 2/221 |
| 2013/0340145 | A1 | 12/2013 | Cooper | |
| 2014/0075650 | A1 | 3/2014 | Garrison | |
| 2014/0259300 | A1 * | 9/2014 | Iosilevich | A45F 3/14 2/300 |

* cited by examiner

SECTION A-A

ALTERNATE SECTION A-A

ALTERNATE SECTION A-A

SECTION B-B

SECTION C-C

PRIOR ART

Section D-D

SECTION E-E

SECTION F-F PRIOR ART

BELT LOOP WITH BELT FASTENER

FIELD OF THE INVENTION

The present invention is generally directed to a belt loop for holding a belt against a garment.

BACKGROUND

Public safety, security, and military personnel may carry tools, weapons, communication equipment, and other supplies and accessories on holsters, carriers, or pouches attached to a belt passing through belt loops attached to a garment such as trousers or a coat. The belt may twist, bend, or break when heavily loaded. Objects suspended from the belt may slide along the belt as the wearer moves about. A second belt may be attached to the first belt to provide additional load-carrying capacity, securely hold attached accessories without sliding along either belt, and distribute weight evenly and more comfortably against the person wearing the belts. The holsters, cases, pouches, and other accessories may be suspended from the inner belt, the outer belt, or both belts.

The belt passing through the belt loops, also referred to as an inner belt, dress belt, or liner belt, has an inner surface which contacts a garment when the belt is worn and an outer surface that contacts the inside of each belt loop the belt passes through. One or more pieces of hook-and-loop material may be strongly affixed to the outer surface on the liner belt. The second or outer belt, also referred to as a duty belt or main belt, may have one or more complementary pieces of hook-and-loop material strongly affixed to the duty belt's inner surface. The pieces of hook-and-loop material on the outer surface of the liner belt may be coupled to the complementary pieces of hook-and-loop material on the inner surface of the duty belt to attach the duty belt to the liner belt.

The duty belt and liner belt may be too large when attached to one another to fit through the belt loops on a garment. The liner belt may therefore be passed through the belt loops and the duty belt attached to the liner belt over the belt loops with the belt loops intervening between the hook-and-loop material on the liner belt and the hook-and-loop material on the duty belt. Each intervening belt loop prevents the portion of hook-and-loop material on the inner surface of the duty belt from coupling to the complementary hook-and-loop material on the liner belt. The outer surface of each belt loop therefore corresponds to an area of detachment between the liner belt and duty belt. The larger the outside surface of each belt loop, and the larger the number of belt loops, the larger the area of detachment of the liner belt to the duty belt.

Detachment of the liner belt and duty belt at each belt loop may contribute to more extensive decoupling of the two belts when the belts are heavily loaded or when the wearer moves about vigorously. Loading or movement may cause an area of detachment between the hook-and-loop material on the joined belts to grow, propagating along the belts from the detached region near each belt loop. An area of detachment may propagate more readily when a load suspended from the duty belt tends to pull or twist the duty belt away from the liner belt. Joined belts interrupted by intervening belt loops may not be able to support as heavy a load as joined belts without intervening belt loops, or may require objects attached to the belt to be repositioned to inconvenient locations along the belt to prevent separation of the joined belts.

Accessories may have a loop or band for suspending the accessory from a liner belt and/or duty belt. When interposed between the duty belt and liner belt, the band may interrupt the hook-and-loop fastener connection between the belts, providing another area of detachment between the belts that can lead to the belts pulling apart from one another. The more accessories worn on a belt, the greater the total possible area of detachment between the belts. The heavier each accessory is, the greater the total potential separation force for pulling the two belts apart.

A duty belt partially or completely separated from a liner belt may create a potential safety hazard should the duty belt slip toward the wearer's legs, possibly impeding walking or running. Detachment of the duty and liner belts, even over a fraction of the belt's total length, may cause a load shift that affects the balance of the person wearing the belts. A partially detached duty belt may require the wearer to interrupt some other activity while reattaching the duty belt to the liner belt or repositioning objects attached to the inner or outer belt.

SUMMARY

An example embodiment includes a belt loop for attachment to a duty belt and to another object such as a garment. The belt loop includes a strip of a flexible material having an upper end, a lower end and an outer surface extending from the upper end to the lower end; and a belt fastener affixed to the strip of flexible material between the upper end and the lower end.

An example of a method embodiment includes securing a duty belt and a liner belt to a garment having at least one belt loop with a belt fastener on the belt loop. An example of the method embodiment includes attaching a first piece of a first part of a hook-and-loop material to a belt loop; attaching the belt loop to a surface of a garment, forming between a first end of the belt loop and a second end of the belt loop an open-sided passage for a sliding fit of a liner belt having a second piece of the first part of the hook-and-loop material attached to the liner belt; and attaching a duty belt having a piece of hook-and-loop material complementary to the first piece on the belt loop to the belt loop and to the liner belt.

Another example embodiment includes a garment including a panel and a belt loop attached to the panel. The belt loop a strip of a material having an upper end, a lower end and an outer surface extending from said upper end to said lower end; and a belt fastener affixed to the strip of material between the upper end and the lower end. The garment optionally includes trousers, wherein the belt fastener is a piece of a hook-and-loop material that extends outward from said outer surface of said belt loop and away from said garment, wherein an open-sided channel/passage is formed between said upper end and said lower end and between said inner surface and said garment.

This section summarizes some features of embodiments of the invention. These and other features, aspects, and advantages of embodiments of the invention will become better understood with regard to the following description and upon reference to the following drawings.

DESCRIPTION

Figure 1:
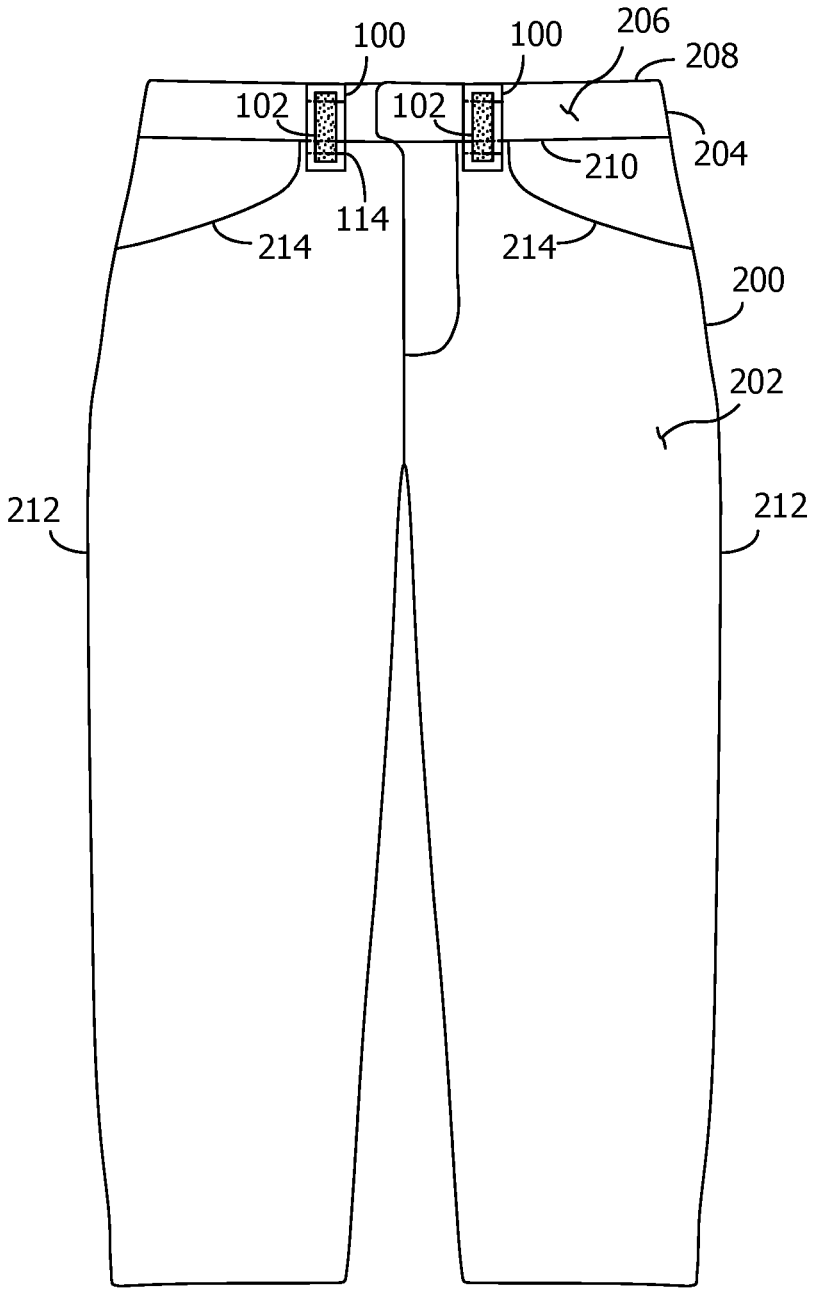
FIG. 1 is a view toward a front side of an example of a garment having belt loops in accord with an embodiment.

An example of a belt loop configured for attachment to a garment includes a belt fastener attached to the belt loop. The belt fastener is positioned to engage with a complementary fastener on a belt that passes over the outside of the belt loop rather than through a passage formed between the belt loop and the surface of an object to which the belt loop is attached, for example the surface of a garment. The belt passing over the outside of the belt loop may be referred to as a duty belt, a main belt, or an outer belt. Another belt, for example a liner belt or an inner belt, may be inserted through the passage between the belt loop and the object to which the belt loop is attached. The belt fastener effectively replaces the segment of hook-and-loop material on a liner belt that is blocked from coupling to a duty belt by an intervening belt loop. Embodiments of a belt loop with a belt fastener increase the area of mechanical attachment between a liner belt and a duty belt when the duty belt is worn on the outside of the belt loop and the liner belt passes through the belt loop, in contrast to previously known belt loops which may be interposed between the attachment surfaces of the inner and outer belts and therefore interfere with attachment between the belts.

Embodiments of a belt loop may be used with a garment or other object configured for receiving a belt. Examples of objects which may include an attached belt loop embodiment include, but are not limited to, trousers, rainwear, a ballistic vest, a coat, a jacket, short trousers, a wetsuit, a dry suit, a flight suit, a coverall, and a padded waist support on a backpack referred to as a hip belt. The disclosed belt loop embodiments are particularly advantageous for accepting a combination of an outer belt and an inner belt joinable to one another by hook-and-loop fastener material, but may also receive ordinary dress belts and casual belts not fitted with hook-and-loop material. The larger the number of belt loops on a garment, the greater the potential advantage of the disclosed embodiments over previously known belt loops due to replacement of lost connections between the inner and outer belts with connections between belt loops and the outer belt. Replacement of the lost connection area between belts becomes increasingly important as the number and/or weight of accessories suspended from the belts increases, especially when the accessories interrupt connections between the belts.

A belt loop embodiment may be made from woven, laminated, extruded, or cast synthetic polymer materials, natural fibers woven into fabric, or metal. Some belt loop embodiments may be made entirely from nonmetallic materials and may therefore not cause alarms when passing through metal detectors of the type commonly found in airports, courtrooms, and other locations attended by law enforcement and security personnel. Belt loop embodiments may be made from materials compatible with conventional garment cleaning procedures.

FIG. 1 shows a view toward a front side 202 of an example of a garment 200 with an example belt loop embodiment 100. The example belt loop 100 is configured for receiving an inner belt through the belt loop, i.e. between the belt loop and garment, and for attachment of an outer belt to a belt fastener 102 on the outside of the belt loop 100. In some embodiments the belt loop 100 may be formed with folded ends 114 for attachment to the garment 200. The example garment 200 in FIG. 1, a pair of trousers, includes two trouser legs 212 joined to one another and to a panel 204 which may be a waistband. The example of a garment 200 may further include a front pocket having an edge 214 at the opening to the interior of the pocket. In the example of FIG. 1, the belt loop 100 is attached to the garment 200 with the belt loop below a top edge 208 of the waistband 204 and a folded end 114 joined to the garment below a bottom edge 210 of the waistband. The folded end 114 may alternatively be joined to the garment above the bottom edge 210 of the waistband 204.

Figure 2:
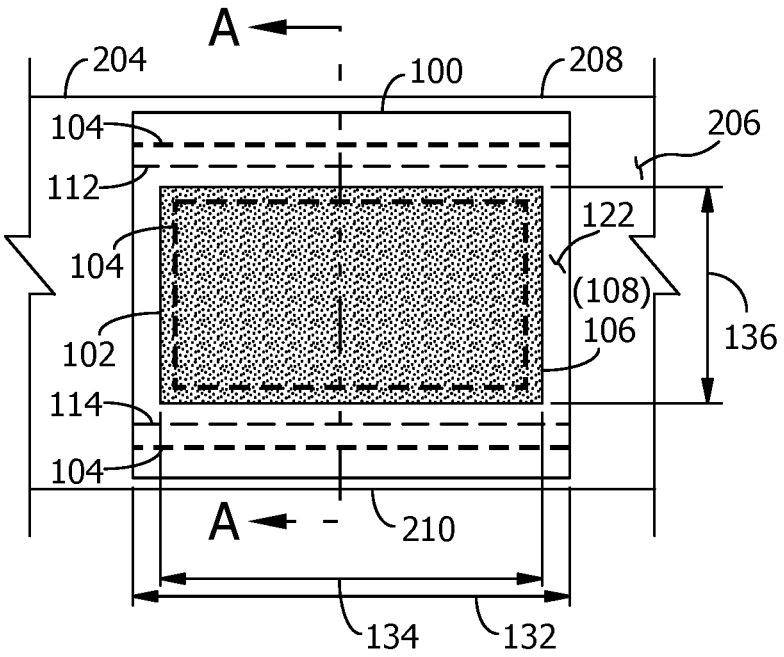
FIG. 2 is view toward an outer surface of the example of a belt loop of FIG. 1.
Figure 3:
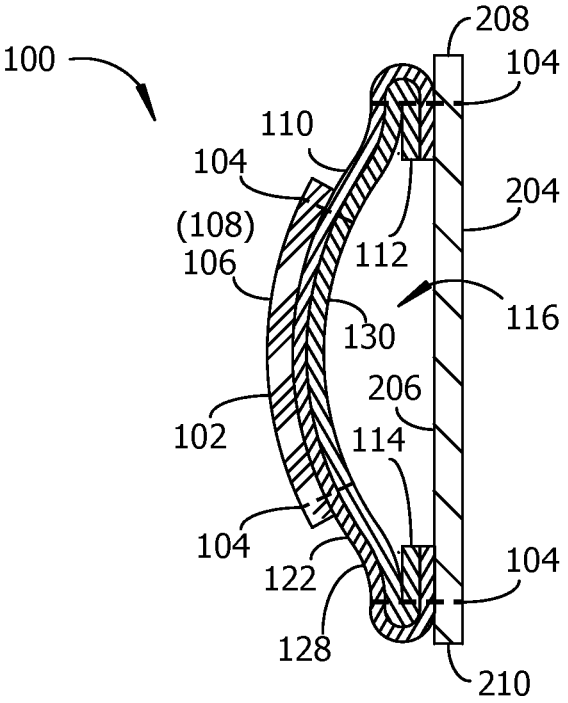
FIG. 3 is a cross-sectional view A-A of the example of a belt loop from FIG. 2. A location and viewing direction for section A-A is marked with section line A-A in FIG. 2.

FIG. 2 shows a view toward an outer surface 122 of an example belt loop 100 attached to the exterior surface 206 of a segment of the panel 204 from FIG. 1. FIG. 3 shows a cross-sectional view A-A of the example belt loop 100 and garment panel 204 of FIG. 2. A belt fastener 102 is strongly attached to the outer surface 122 of the belt loop 100 by means for attaching 104. Examples of means for attaching 104 include, but are not limited to, stitching, adhesive, rivets, staples, grommets, threaded fasteners, and fusing by application of heat or solvents. The belt fastener 102 may be one of the complementary parts of a flexible hook-and-loop material, for example the loop part 106 or alternately the hook part 108. Hook-and-loop material may also be referred to as thistle cloth.

In the figures, a reference designator in parenthesis identifies an alternative to another, nearby reference designator. For example, reference designator (108) in FIG. 2 marks an alternative component for nearby reference designator 106. The part of hook-and-loop material on the belt loop 100, whether the hook part 108 or the loop part 106, is preferably the same part of hook-and-loop material as on the inner belt and is preferably complementary, i.e. mechanically adheres to, to the part of hook-and-loop material on the outer belt. For example, the belt fastener 102 includes the loop part 106 of hook-and-loop material for attachment to an outer belt that includes the hook part of hook-and-loop material. Alternatively, the belt fastener 102 includes the hook part 108 of hook-and-loop material when the outer belt includes the loop part on the outer belt's inner surface.

The example belt loop embodiment 100 of FIGS. 2-3 may be formed from a flexible strip of material 110 folded to form two layers, an outer layer 128 having an outer surface 122 and an inner layer 130. The two layers may be folded again to form a first folded end 112 of the belt loop 100 and a second folded end 114 opposite the first folded end. Alternately, separate strips of material may be joined together to form the belt loop 100. The first folded end 112 and second folded end 114 may be joined to the surface 206 of the garment 200 by means for fastening 104 to form an open-sided passage 116 between the belt loop 100 and the garment panel 204. The open-sided passage 116 is preferably large enough to accept an inner belt with a sliding fit, although the belt loop 100 may be optionally be sized for a loose fit of the inner belt. The belt fastener 102 may be formed with a first linear dimension 134 that is approximately equal to or alternatively at least eighty percent (80%) of the first linear dimension 132 of the belt loop 100.

Figure 4:
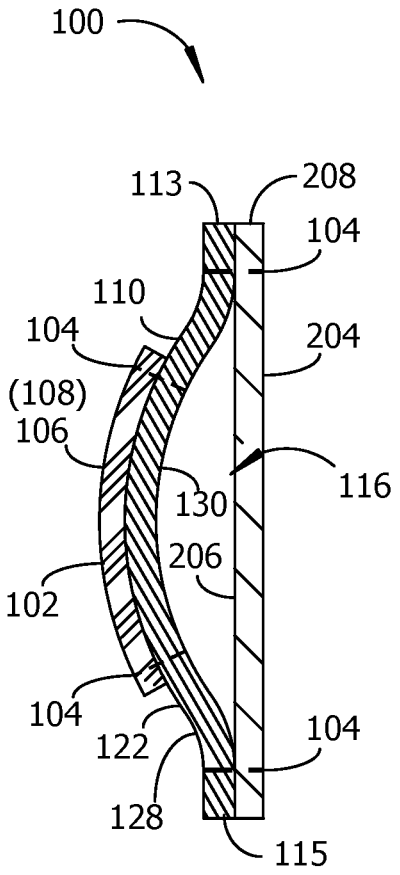
FIG. 4 is an alternate cross-sectional view A-A in which the ends of the belt loop extend outward rather than being folded under as in the example of FIG. 3.

The example belt loop embodiment 100 may have turned-under folded ends, for example a first folded end 112 and a second folded end 114 as shown in FIG. 3. An alternative belt loop embodiment 100 may have ends that are not turned under as shown in the alternative cross-sectional view A-A of FIG. 4. In the example of FIG. 4, a first end 113 extends away from the open-sided passage 116. A liner belt or a dress belt (not shown in FIG. 4) may be passed through open-sided passage 116. Opposite the first end 113, a second end 115 of the belt loop 100 extends away from the open-sided passage 116. FIG. 4 further illustrates an example of a belt loop 100 made from a belt fastener 102 joined to a single layer of material 110. The belt loop example of FIG. 4 may alternatively be made from more than one layer of material, for example a laminate or a folded material, and may be formed from more than one type of material.

Figure 5:
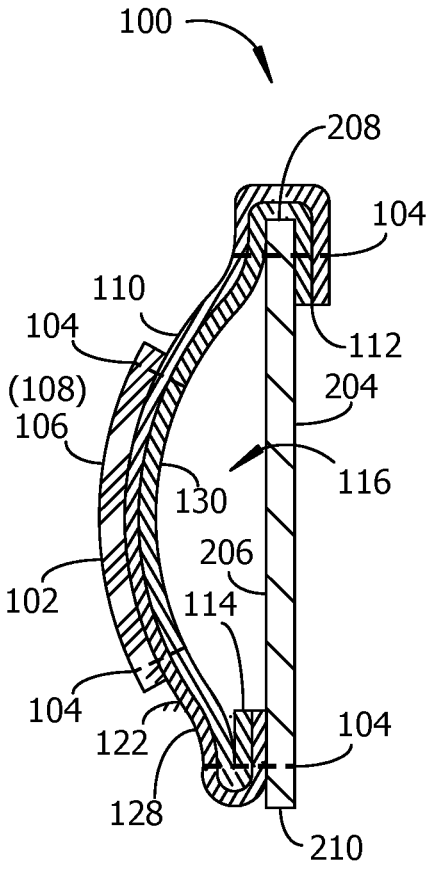
FIG. 5 is an alternate cross-sectional view A-A in which the top end of the belt loop extends over and around the top edge of a waistband on trousers.

Another alternative example of a belt loop embodiment is shown in FIG. 5. In the example of FIG. 5, the upper end of the belt loop wraps around the top edge 208 of the waistband, attaching to both the interior and exterior surfaces of the waistband.

Figure 6:
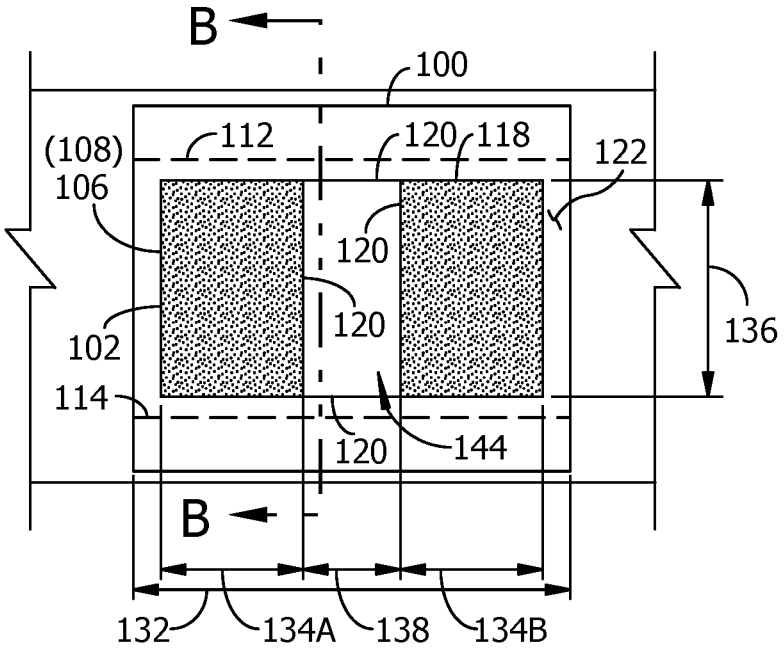
FIG. 6 is a view toward an outer surface of an alternative embodiment of a belt loop.
Figure 7:
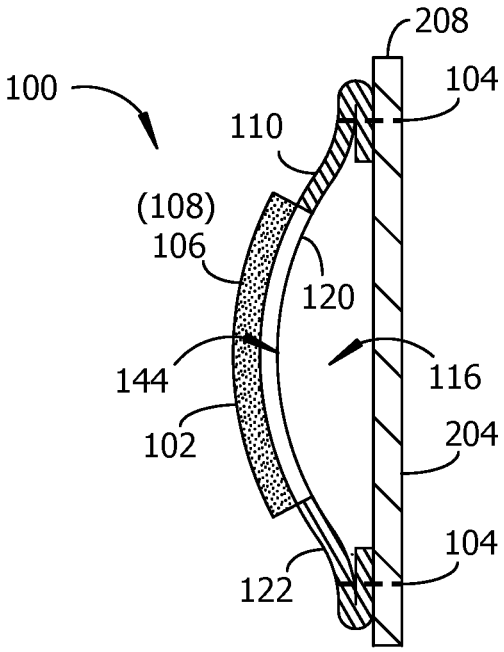
FIG. 7 is a cross-sectional view B-B of the alternative belt loop embodiment from FIG. 6. A location and viewing direction for section B-B is marked with section line B-B in FIG. 6.

Another example embodiment of a belt loop includes more than one belt fastener, for example more than one piece of hook-and-loop material, attached to the belt loop. In the examples of FIGS. 6-7, a first piece of hook-and-loop material with a first linear dimension 134A, for example the loop part 106, and a second piece of hook-and-loop material 118 with a first linear dimension 134B, are both joined to the outer surface 122 of the belt loop 100. The two pieces of hook-and-loop material may be separated from one another by a separation distance 138 preferably less than about twenty percent (20%) of the first linear dimension 132 of the belt loop 100. When more than one piece of hook-and-loop material is attached to the outside of a belt loop 100, at least two of the pieces are preferably a same type of hook-and-loop material complementary to the hook-and-loop material on a duty belt.

FIGS. 6-7 further illustrate an example belt loop embodiment 100 having an optional aperture 144 through the outer surface 122 of the belt loop. Aperture edges 120 mark the position of an aperture 144 formed in the outer surface 122. The aperture is large enough to allow hook-and-loop fastener material on an inner belt in the passage 116 to extend through the +aperture and strongly attach to complementary hook-and-loop material on an outer belt passing over the belt loop 100. Hook-and-loop material on the outer belt also attaches to the first 106 and second 118 pieces of hook-and-loop material on the outer surface 122 of the belt loop 100. In the examples of FIGS. 6-7, opposing edges 120 of an optional aperture 144 are positioned between two separated pieces of hook-and-loop fastener material extending outward from the outer surface 122 of the belt loop 100.

Figure 8:
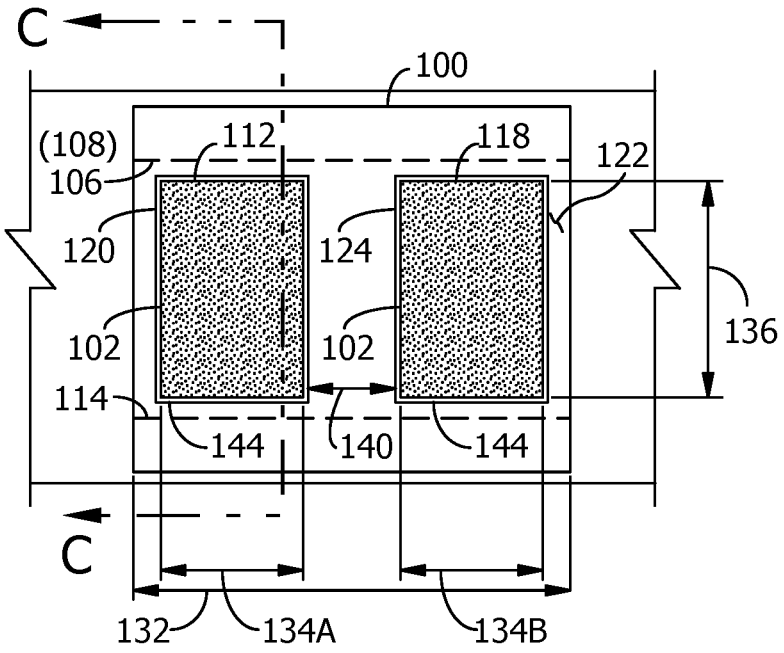
FIG. 8 is view toward an outer surface of another alternative embodiment of a belt loop.
Figure 9:
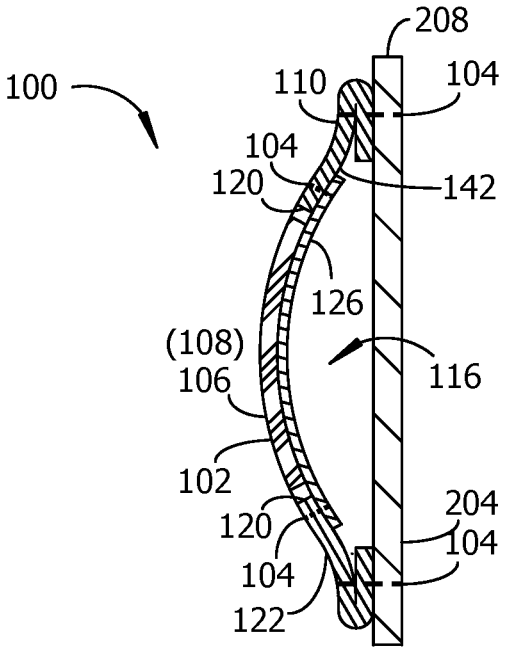
FIG. 9 is a cross-sectional view C-C of the alternative belt loop embodiment from FIG. 8. A location and viewing direction for section C-C is marked with section line C-C in FIG. 8.

In the examples of FIGS. 1-7, the belt fastener 102 is strongly attached to an outer surface 122 of the belt loop 100. FIGS. 8-9 show an example of an alternative embodiment of a belt loop 100 with the belt fastener 102 attached to an inner surface 142 of the belt loop, where the inner surface 142 in the open-sided passage 116 of the belt loop 100 faces toward the garment panel 204. In the example of FIGS. 8-9, each belt fastener 102 extends into an aperture 144 through the inner 142 and outer 122 surfaces of the belt loop, for example a first aperture 144 with a peripheral edge 120 and a second aperture 144 with a peripheral edge 124. The two apertures may be spatially separated on the outer surface 122 of the belt loop by a distance 140. A backing layer 126 for the belt fastener 102 may be joined to the fabric strip 110 by means for fastening 104 with the loop part 106, or alternately the hook part 108, extending into the aperture 144 formed between edges 120. The loop part 106 or the hook part 108 may optionally extend outward from the outer surface 122 of the belt loop 100 or may be approximately even with the outer surface 122. In the example of FIG. 8, two apertures 144 are provided for the two belt fasteners 102. Both belt fasteners 102 may alternatively extend into a single aperture 144 formed in the belt loop 100.

Figure 10:
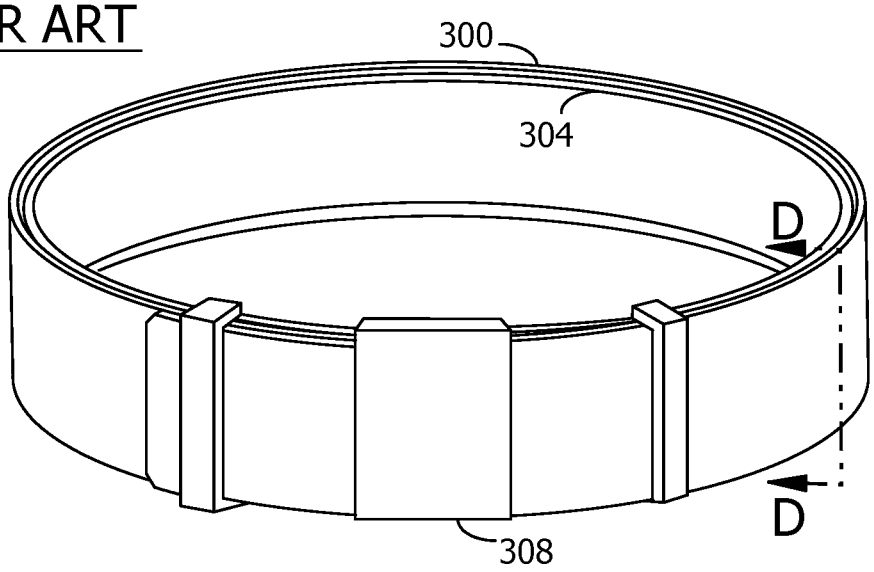
Fig. 10 PRIOR ART
FIG. 10 is a pictorial view of an example of an inner belt, also referred to as a liner belt, and attached by hook-and-loop fastener material to an example of an outer belt, also referred to as a main belt or a duty belt (PRIOR ART).
Figure 11:
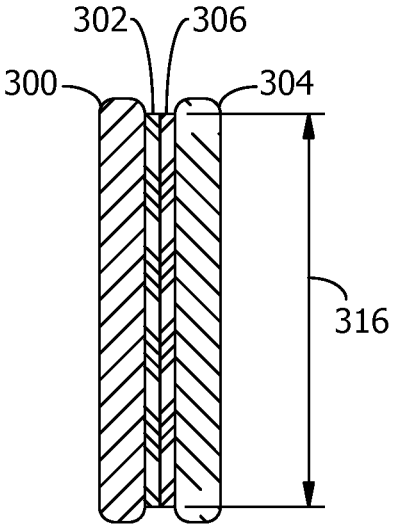
FIG. 11 is a cross-sectional view D-D of the liner and duty belt examples of FIG. 10. A location and viewing direction for section D-D is marked with section line D-D in FIG. 10 (PRIOR ART).

Examples of commercially available inner and outer belts are shown in FIGS. 10-11. A duty belt 300 may be joined to a liner belt 304 by complementary pieces of hook and loop fastener material. FIGS. 10-11 further represents an example of a duty belt 300 as the outer belt and a liner belt 304 as the inner belt. A buckle 308, latch, snap, or hook-and-loop material provides an adjustable closure for the belts. One of the parts of hook-and-loop material 302 on the duty belt couples to the complementary part of the hook-and-loop material 306 on the liner belt 304. As suggested in the examples of a belt loop embodiment 100 in FIGS. 2, 6, 8, and 12, a second linear dimension 136 of the belt fastener 102 may be approximately equal to the corresponding transverse dimension 316 of the hook-and-loop fastener material 306 on the liner belt 304.

Figure 12:
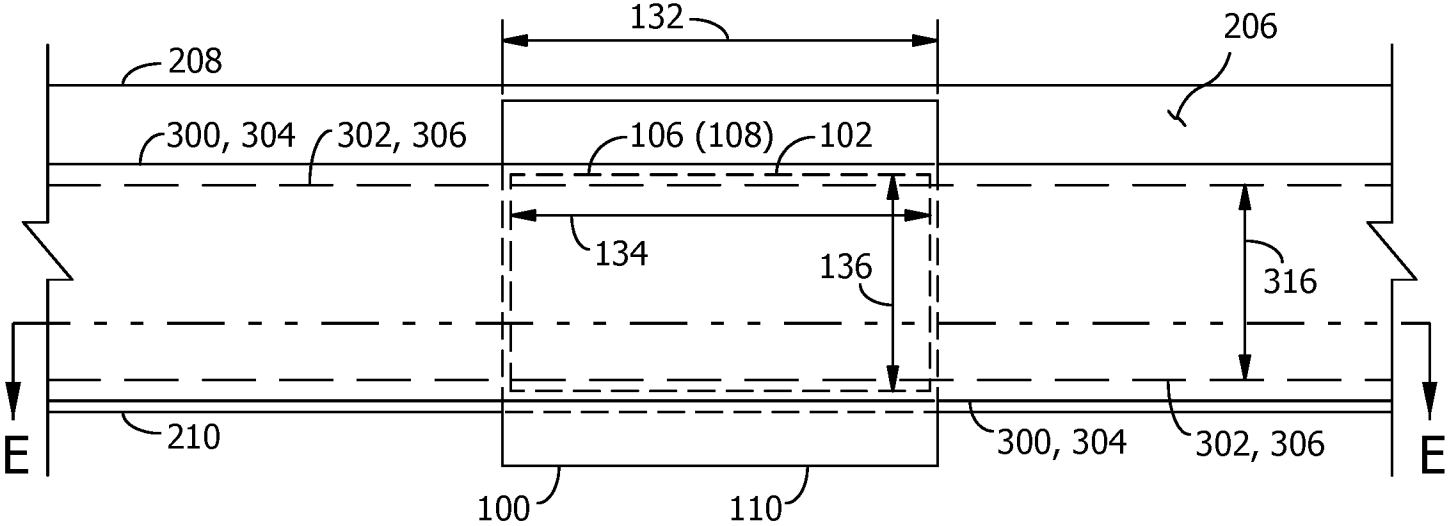
FIG. 12 is a front view toward the outer surface of a duty belt attached to an example embodiment of a belt loop by a belt fastener joined to the belt loop.
Figure 13:
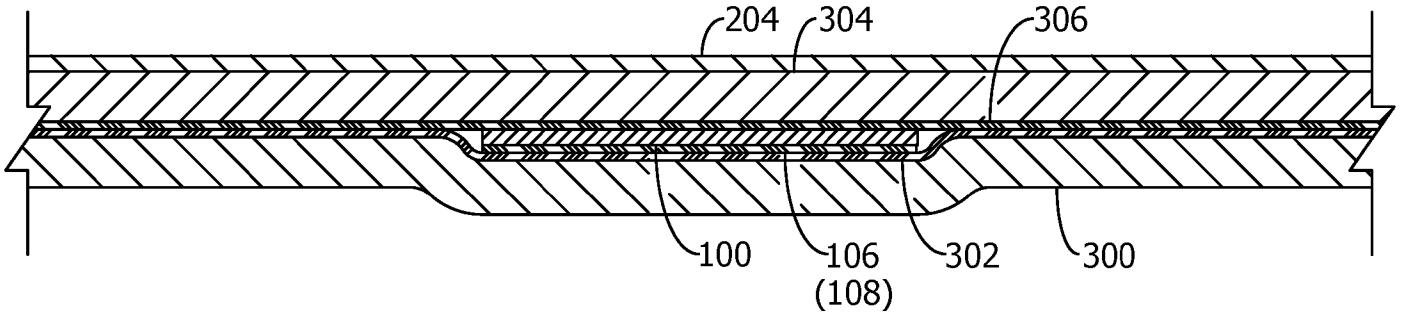
FIG. 13 is a cross-sectional view E-E of the examples of a liner belt, duty belt, and belt loop embodiment from FIG. 12. A location and viewing direction for section E-E is marked with section line E-E in FIG. 12.

FIGS. 12-13 show an example of a liner belt 304 passing through a belt loop 100. The figures further show an example of an outer belt 300, for example a duty belt 300, passing over and attaching to the outer surface 122 of the belt loop 100. Hook-and-loop fastener material 302 on the outer belt 300 adheres to the complementary hook-and-loop fastener material of the belt fastener 102 and to complementary hook-and-loop fastener material 306 on the inner belt 304. The duty belt 300 may be secured to the belt loop embodiment 100 by the belt fastener 102 over at least eighty percent (80%) of the first linear dimension 132 of the belt loop 100, although other sizes for the contact area between the belt loop and duty belt may be provided. Parts of the hook-and-loop fastener 302 on the duty belt not in contact with the belt loop 100 are available for connection to the complementary hook-and-loop fastener 306 on the inner belt 304. The liner belt 304 in FIGS. 12-13 further represent an example of an inner belt 304. The duty belt 300 further represents an example of an outer belt 300.

Figure 14:
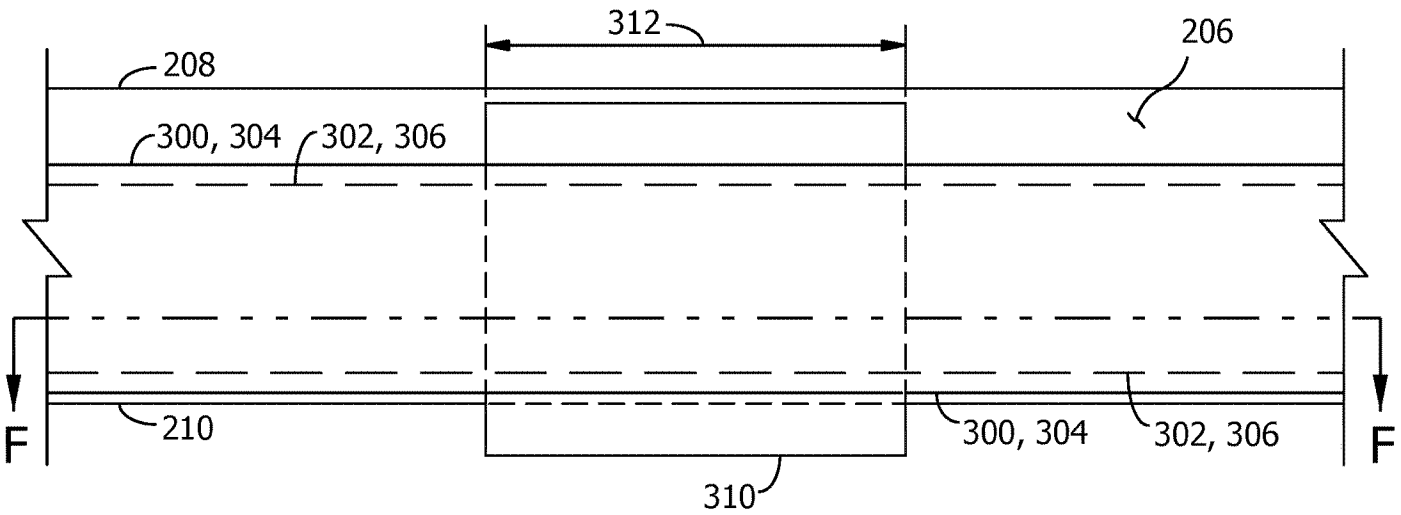
Fig. 14 PRIOR ART
FIG. 14 is a front view toward the outer surface of a duty belt on a garment having an example of a belt loop lacking a belt fastener (PRIOR ART).
Figure 15:
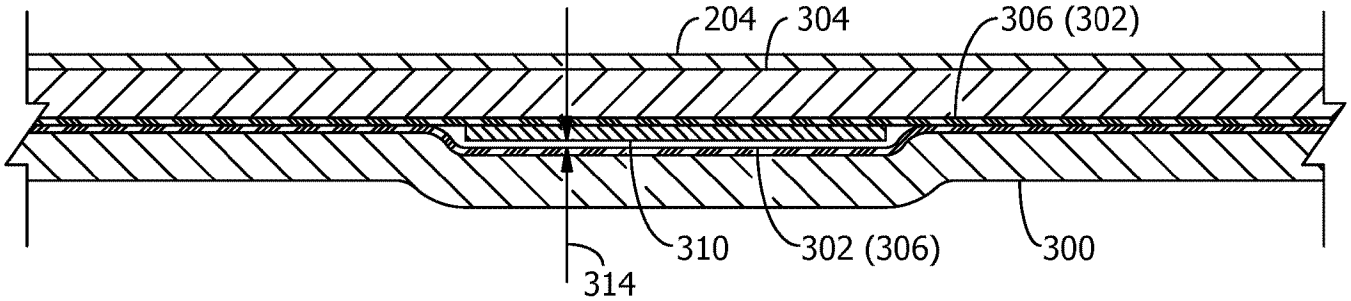
FIG. 15 is a cross-sectional view F-F of the examples of the prior art liner belt, duty belt, and belt loop from FIG. 14. A location and viewing direction for section F-F is marked with section line F-F in FIG. 14. PRIOR ART

In contrast to the examples of a belt loop embodiment 100 in FIGS. 1-9 and 12-13, a belt loop lacking a belt fastener, for example the prior art belt loop 310 in the example of FIGS. 14-15, interrupts connection of the outer belt to the inner belt when the inner belt passes through the belt loop and the outer belt passes over the outside of the belt loop. An unattached area between the outer belt and the inner belt is formed at each prior art belt loop 310. The unattached area is represented in FIG. 15 by a gap 314 extending for at least the distance of a linear dimension 312 along the prior art belt loop 310 between the outer surface of the belt loop 310 and the hook-and-loop material (302 or the complementary part 306) on the outer belt 300. The length of the gap 314 shows the approximate position of a corresponding segment of fastener material on the duty belt that is not attached to the complementary fastener material on the liner belt.

An alternative embodiment comprises a method for securing a duty belt and a liner belt to a garment having belt loops with a belt fastener. An example of the method embodiment includes:

attaching a first piece of a first part of a hook-and-loop material to a belt loop;

attaching the belt loop to a surface of a garment, forming between a first end of the belt loop and a second end of the belt loop an open-sided passage for a sliding fit of a liner belt having a second piece of the first part of the hook-and-loop material attached to the liner belt; and attaching a duty belt having a piece of hook-and-loop material complementary to the first piece on the belt loop to the belt loop and to the liner belt.

The example of a method embodiment may optionally include the following, individually or in any combination:

attaching the first piece of the first part of the hook-and-loop material to an outer surface of the belt loop;

forming an aperture through an inner surface and an outer surface of the belt loop and attaching the first piece of the first part of the hook-and-loop material to the inner surface of the belt loop with a part of the first piece extending into the aperture;

forming the first piece of the first part of the hook-and-loop material to have a first linear dimension of at least eight percent (80%) of a corresponding first linear dimension of the belt loop;

attaching another piece of the first part of the hook-and-loop material to an outer surface of the belt loop;

forming an aperture through an outer surface of the belt loop and coupling the duty belt to the liner belt through the aperture; and attaching the first piece and the another piece of the first part of the hook-and-loop material on opposite sides of the aperture.

Unless expressly stated otherwise herein, ordinary terms have their corresponding ordinary meanings within the respective contexts of their presentations, and ordinary terms of art have their corresponding regular meanings.

What is claimed is:

1. A garment configured to be worn with a belt, comprising:

a belt loop comprising:

a strip of a material comprising:

an upper end directly attached to said garment;

a lower end opposite said upper end, said lower end directly attached to said garment;

an outer surface extending from said upper end to said lower end; and an inner surface opposite said outer surface, said strip of material formed with an aperture extending through said inner surface and said outer surface;

a first piece of a hook-and-loop material affixed attached to said strip of material adjacent an edge of said aperture;

a second piece of said hook-and-loop material affixed to said strip of material adjacent an opposite edge of said aperture; and an open-sided channel formed between said upper end and said lower end and between said inner surface and said garment, wherein said first piece of hook-and-loop material and said second piece of hook-and-loop material extend outward from said outer surface of said belt loop and away from said garment.

2. The garment configured to be worn with the belt of claim 1, wherein said first piece of hook-and-loop material and said second piece of hook-and-loop material are each formed from a hook portion of said hook-and-loop fastener material.

3. The garment configured to be worn with the belt of claim 1, wherein said first piece of hook-and-loop material and said second piece of hook-and-loop material are each formed from a loop portion of said hook-and-loop fastener material.

4. The garment configured to be worn with the belt of claim 1, wherein said belt loop further comprises a first folded end formed by folding said upper end toward said lower end.

5. The garment configured to be worn with the belt of claim 1, wherein said belt loop further comprises a second folded end formed by folding said lower end toward said upper end.

* * * * *